US011877673B2

(12) United States Patent
Gady et al.

(10) Patent No.: US 11,877,673 B2
(45) Date of Patent: Jan. 23, 2024

(54) MODULAR PRODUCT DISPLAY UNIT

(71) Applicant: Apple Inc., Cupertino, CA (US)

(72) Inventors: Jean-Marc Gady, Los Altos, CA (US); Gabriel J. Lamb, Burlingame, CA (US); Simona M. Szabados, San Francisco, CA (US); Hyun Jin Kim, San Francisco, CA (US); Seung Chae Kang, New York, NY (US); Indhu V. Solayappan, Sunnyvale, CA (US); Joshua Robert Edwards, Santa Cruz, CA (US); Alice Marlin Brugger, San Francisco, CA (US); Jake A. Nelson, Berkeley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/705,008

(22) Filed: Mar. 25, 2022

(65) Prior Publication Data

US 2023/0157463 A1 May 25, 2023

Related U.S. Application Data

(60) Provisional application No. 63/281,571, filed on Nov. 19, 2021.

(51) Int. Cl.
*A47F 5/00* (2006.01)
*A47B 88/975* (2017.01)

(52) U.S. Cl.
CPC ..... *A47F 5/0018* (2013.01); *A47B 88/975* (2017.01); *A47F 5/005* (2013.01)

(58) Field of Classification Search
CPC ..... A47F 5/0018; A47F 5/005; A47F 5/132; A47F 7/144; A47B 57/58; A47B 57/583; A47B 57/585; A47B 57/586; A47B 65/15; A47B 96/04; A47B 88/969; A47B 88/975; A47B 2088/976; A47B 2088/977; A47B 88/988; A47B 88/994; A47B 2096/207; A47B 2096/209; B65D 25/06; B65D 25/04
USPC ..... 211/13.1, 10, 184, DIG. 1; 312/348.3; 206/350, 818, 561; 248/206.5, 309.4;
(Continued)

(56) References Cited

U.S. PATENT DOCUMENTS 1,677,544 A * 7/1928 Gourley ..... A47B 88/90 211/184
2,459,561 A * 1/1949 Yawman ..... A47B 88/994 220/529
(Continued)

FOREIGN PATENT DOCUMENTS

CN 201641078 U 11/2010
EP 2859815 A2 4/2015
(Continued)

*Primary Examiner* — Jennifer E. Novosad
(74) *Attorney, Agent, or Firm* — Sterne, Kessler, Goldstein & Fox P.L.L.C.

(57) ABSTRACT

A modular product display unit includes a tray and display inserts. The tray includes a magnetic top surface and an apron at least partially surrounding the magnetic top surface and extending above the magnetic top surface. The display inserts are disposed on and magnetically coupled to the magnetic top surface, the display inserts form product-display compartments on the magnetic top surface.

28 Claims, 17 Drawing Sheets

(58) Field of Classification Search
USPC ..... 220/510, 528, 529, 534, 549, 544, 551; 108/60, 61
See application file for complete search history.

(56) References Cited

U.S. PATENT DOCUMENTS 2,945,732 A * 7/1960 Edmondson, Jr. ... A47B 88/975 211/184
3,021,186 A * 2/1962 Immermann ..... G09F 3/20 312/140.3
3,138,283 A * 6/1964 Peebles ..... A47B 65/15 211/11
3,410,445 A * 11/1968 Pilley ..... A47B 88/994 229/120.34
3,746,181 A * 7/1973 Benoit ..... A47F 5/005 217/18
4,071,286 A * 1/1978 Moyer ..... G03B 21/54 312/348.3
4,258,856 A * 3/1981 Marling ..... A47B 88/90 24/301
4,488,653 A * 12/1984 Belokin ..... A47F 5/005 211/DIG. 1
4,705,168 A * 11/1987 Ward ..... A47B 88/988 206/376
5,269,083 A * 12/1993 Vampatella ..... A47G 1/065 248/467
5,477,631 A * 12/1995 Hewitt ..... G09F 7/10 206/39
5,607,215 A * 3/1997 Pacetti ..... A47B 88/975 312/348.3
5,651,596 A * 7/1997 Carlson ..... A47B 88/994 312/334.32
6,039,178 A * 3/2000 Ernst ..... B25H 3/06 211/70.6
6,073,766 A * 6/2000 Winnard ..... A45C 13/02 206/378
6,073,794 A * 6/2000 Bidot ..... A47B 88/975 312/348.3
6,364,136 B1 * 4/2002 Weshler ..... A47F 5/103 211/175
6,400,247 B1 * 6/2002 King ..... B65D 85/00 220/8
6,614,337 B1 * 9/2003 Winnard ..... H01F 7/0252 335/286
6,695,419 B2 * 2/2004 Searer ..... A47B 88/975 312/348.3
6,871,921 B2 * 3/2005 Ernst ..... A47B 88/994 312/348.3
7,905,354 B1 * 3/2011 Geibel ..... B25H 3/06 206/378
8,317,040 B2 * 11/2012 Lanning ..... A47B 96/04 211/DIG. 1
8,336,709 B1 * 12/2012 Geibel ..... B25H 3/06 206/378
8,635,718 B1 * 1/2014 Giagni, Sr. ..... E03C 1/186 4/514
8,727,457 B2 * 5/2014 Marshall ..... A47B 88/994 312/246
8,807,355 B2 * 8/2014 Merey ..... A47B 97/00 312/348.3
8,960,824 B2 * 2/2015 Wilcox ..... F25D 25/025 312/348.3
9,486,090 B2 * 11/2016 Juric ..... A47F 5/0093
10,182,652 B1 * 1/2019 Spielmann ..... A47F 5/005
10,206,505 B2 * 2/2019 Qualkinbush ..... B65D 11/1866
10,835,040 B1 * 11/2020 El-Sayed ..... A47B 88/994
10,952,548 B2 * 3/2021 Pollpeter ..... F21S 4/28
D953,786 S * 6/2022 Bruegmann ..... D6/706
11,503,910 B1 * 11/2022 Carmen ..... A47B 88/975
2003/0184199 A1 * 10/2003 Jananji ..... A47B 88/975 312/348.3
2003/0227241 A1 * 12/2003 LaBonia, Jr. ..... A47B 88/975 312/348.3
2004/0095048 A1 * 5/2004 Jolin ..... A47B 88/90 312/348.3
2005/0113970 A1 * 5/2005 Holmes ..... A47B 88/988 700/242
2005/0264147 A1 * 12/2005 Norris ..... A47B 88/90 312/348.3
2007/0108149 A1 * 5/2007 Lee ..... A47B 47/0083 211/187
2008/0083753 A1 * 4/2008 Escobar ..... A47B 88/994 220/8
2008/0237084 A1 * 10/2008 Hopkins ..... A47F 7/146 206/561
2012/0319550 A1 * 12/2012 Manniso ..... A47B 88/994 312/348.3
2014/0091685 A1 * 4/2014 Greenwood ..... A47B 73/00 312/348.3
2014/0210331 A1 * 7/2014 Tunzi ..... F25D 25/00 29/428
2014/0284225 A1 * 9/2014 Davis ..... B44D 3/02 206/1.8
2014/0346068 A1 * 11/2014 Omura ..... B65D 25/06 206/534
2020/0221870 A1 * 7/2020 Lawson ..... A47B 88/941
2020/0345140 A1 * 11/2020 Chalifoux ..... A47B 88/975
2021/0341218 A1 * 11/2021 Wei ..... A47B 88/975
2022/0287460 A1 * 9/2022 Guzeltepe ..... F16B 1/00
2023/0157463 A1 * 5/2023 Gady ..... A47F 5/10 211/13.1

FOREIGN PATENT DOCUMENTS

GB 2019365 A 10/1979
WO 2019125540 A1 6/2019

* cited by examiner

MODULAR PRODUCT DISPLAY UNIT

CROSS REFERENCE TO RELATED APPLICATIONS

This application claims priority to and the benefit of U.S. Provisional Patent Application No. 63/281,571, filed Nov. 19, 2021, titled "Modular Product Display Drawer," which is incorporated herein in its entirety by reference thereto.

FIELD

The described embodiments relate generally to product displays. More particularly, the present embodiments relate to retail product display units (e.g., display trays or drawers).

BACKGROUND

Custom product displays can be costly and product-specific. Further, some custom displays may have diminished continued value after the products they were custom-built to display are no longer sold, or it may be complex to convert them to accommodate and display different products for which they were not originally designed.

SUMMARY

Some embodiments of a modular product display unit include a tray and display inserts. The tray includes a magnetic top surface and an apron at least partially surrounding the magnetic top surface and extending above the magnetic top surface. The display inserts are disposed on and magnetically coupled to the magnetic top surface. The display inserts form product-display compartments on the magnetic top surface.

In some embodiments, the display inserts are reconfigurable on the magnetic top surface. In some embodiments, the display inserts are coupled to the magnetic top surface without mechanical fasteners. In some embodiments, the positions of the display inserts on the magnetic top surface are constrained only by the apron or other display inserts. In some embodiments, the display inserts are linear and form rectangular compartments. In some embodiments, the display inserts include dividers and product stands.

In some embodiments, the modular product display unit includes product backers magnetically coupled to the magnetic top surface and each disposed within one of the compartments. In some embodiments, the product backers comprise an upright support member extending away from the magnetic top surface for supporting product disposed within the cavies.

In some embodiments, the modular product display unit includes products disposed within the compartments. In some embodiments, the upright support members of the product backers extend above top surfaces of the apron. In some embodiments, the upright support members of the product backers do not extend above top surfaces of the products.

In some embodiments, the top surfaces of the display inserts do not extend above top surfaces of the apron.

In some embodiments, at least one of a length or width of at least one of the compartments is at least 10 times its depth.

Some embodiments of a modular product display drawer include a magnetic surface and display inserts magnetically coupled to the magnetic surface, the display inserts being reconfigurable on the magnetic surface to form product-display compartments. The product display drawer includes a drawer support having a drawer slide configured to allow the magnetic surface to slide between a first position and a second position.

In some embodiments, the drawer support is coupled to a mounting surface in a cantilevered arrangement.

In some embodiments, the modular product display drawer includes product backers magnetically coupled to the magnetic surface and each disposed within one of the compartments. In some embodiments, the product backers include an upright support member extending away from the magnetic surface for supporting product disposed within the compartments.

In some embodiments, the modular product display drawer includes an apron surrounding and extending above the magnetic surface, and the display inserts include linear dividers. In some embodiments, top surfaces of the display inserts do not extend above the apron.

In some embodiments, the modular product display drawer includes product backers, each magnetically coupled to the magnetic surface within one of the compartments, where the product backers extend above the top surfaces of the apron.

Some embodiments of a retail display fixture include a mounting surface and display trays mounted to the mounting surface in a cantilevered arrangement. The display trays include a magnetic horizontal surface and display inserts disposed on and magnetically coupled to the magnetic horizontal surface, the display inserts forming product-display compartments on the magnetic horizontal surface. The display trays are movable toward and away from the mounting surface between a first position and a second position.

In some embodiments, the retail display fixture includes a plurality of the display trays mounted to the mounting surface in a column configuration. In some embodiments each display tray in the column of the display trays is vertically spaced apart from an adjacent one of the display trays by between 1 and 5 times a height of the display tray.

In some embodiments, each display tray of the retail display fixture further includes an apron at least partially surrounding the magnetic horizontal surface, and drawer slides coupling the respective display tray to the mounting surface in the cantilevered arrangement. The display inserts include dividers forming the compartments where the dividers do not extend above the apron, a product stand for supporting an unpackaged product for display, and a product backer for supporting packaged product within a compartment, where the display inserts are coupled to the magnetic horizontal surface without mechanical fasteners, and are reconfigurable on the magnetic horizontal surface.

Some embodiments of a modular product display unit include a tray having a top surface, display inserts movably disposed on the top surface, and a retention mechanism that couples the display inserts to the top surface and holds the display inserts in position relative to the top surface. The display inserts form product-display compartments on the top surface, and the display inserts protrude away from the top surface to form walls of the product-display compartments. The retention mechanism can be overcome by lifting the display inserts away from the top surface, and the retention mechanism can be engaged by placing the display inserts on the top surface.

In some embodiments, the retention mechanism includes magnetic attraction of the display inserts toward the top surface. In some embodiments the retention mechanism includes a first magnetic element at or below the top surface and second magnetic elements forming at least a portion of each of the display inserts, where at least one of the first magnetic element and the second magnetic elements is a magnet. In some embodiments the retention mechanism includes a first magnetic element at or below the top surface and second magnetic elements forming at least a portion of each of the display inserts, where the first magnetic element is a ferromagnetic panel, and the second magnetic elements are permanent magnets.

In some embodiments the retention mechanism does not include mechanical fasteners. In some embodiments the retention mechanism can couple the display inserts to the top surface and hold the display inserts in position relative to the top surface at any position on the top surface.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
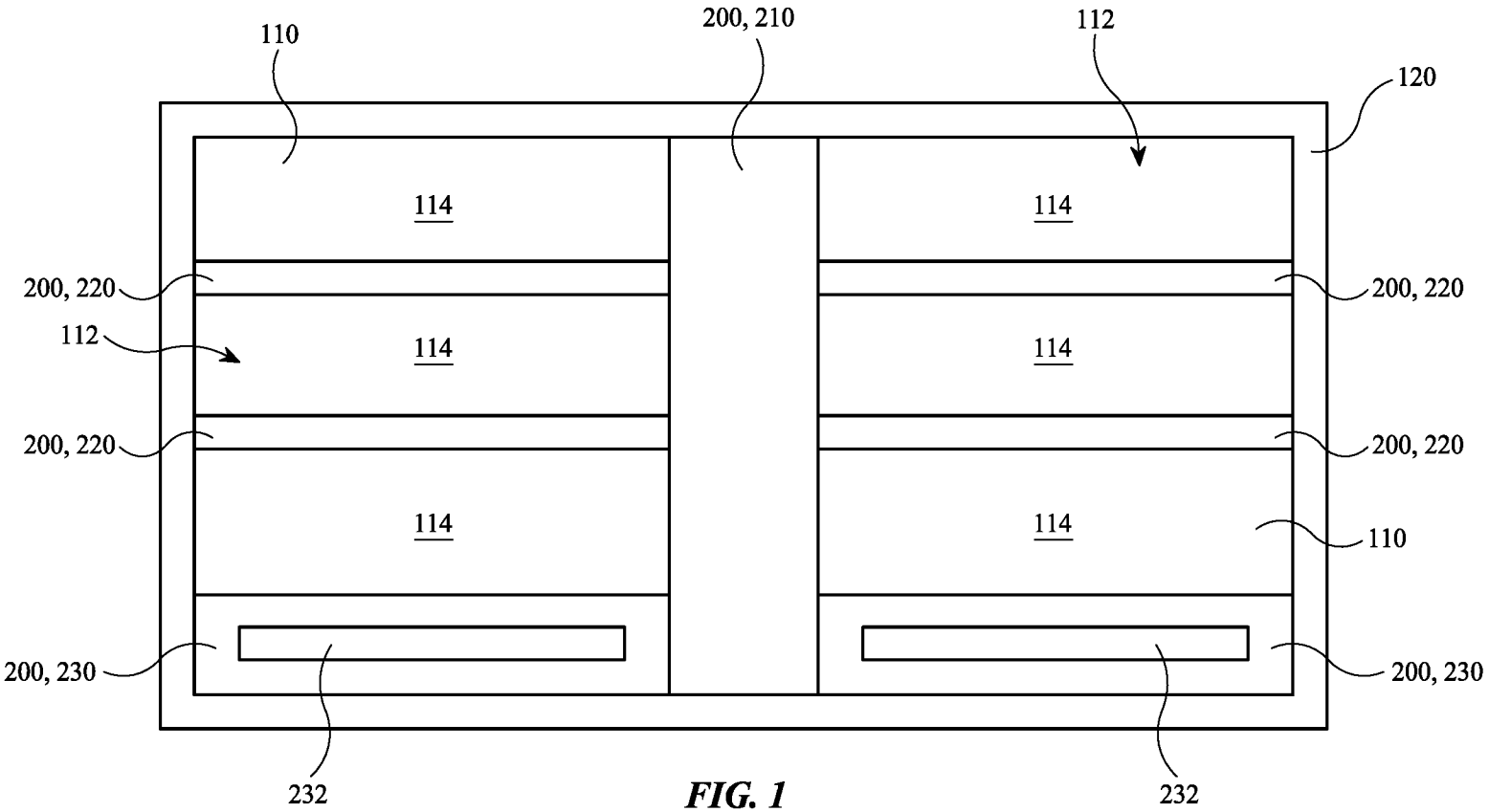
FIG. 1 shows a top view of a retail display tray.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

The following disclosure relates to a modular product display unit, for example a tray, which in some embodiments may be configured as a drawer, and which in some implementations may be used in a retail store to display product available for customer evaluation or purchase.

For example, in some embodiments a display tray includes display inserts that can be rearranged to accommodate differently sized and shaped products or packaging, and to accommodate for diminishing supply of product in the display tray. The customizable display tray helps to reduce cost since it can be easily reconfigured to accommodate as new products as they are developed, irrespective of differences in the new product's packaging dimensions and shape.

Instead of replacing the display tray when a new product is developed, the display inserts can be moved or replaced to accommodate the size(s) and shape(s) of the new product. Further, the display tray increases the aesthetics of the product display by allowing for the display inserts to be rearranged as the stock of the products begin to diminish, to maintain the remaining stock in a consistent and desired arrangement.

The display tray can include a top surface having a cavity to store products, an apron extending around the cavity, and inserts within the cavity defining compartments within which products can be positioned for display and sale. The inserts can be reconfigurable to account for diminishing product stock or to accommodate different products. The inserts are removably coupled to the top surface via a retention mechanism without any visible or fixed connections. In some embodiments, the inserts are coupled to the top surface magnetically. For example the inserts may include magnets, and the tray may include magnetic materials beneath the top surface that will attract the magnets of the inserts. In other embodiments the inserts may be coupled to the top surface in other ways, for example, by friction or pressure created between the inserts and the apron.

In some embodiments, the top surface of the display tray is magnetic. Magnetic display inserts can be arranged on the top surface to form internal walls that define compartments within the cavity. The magnetic display inserts may include magnets, and may thereby couple to the display surface magnetically and maintain their position within the cavity. Each compartment can store one or more products. Depending on the dimensions of the products, the magnetic display inserts can be arranged to help maintain the products in a desired position (e.g., an upright position to prevent the products from falling). After one or more products are removed from the display tray (e.g., by a customer taking them for purchase), the display inserts can be rearranged to accommodate the smaller product inventory within the display tray. And in the case where the display tray is to be used to display new or different product from that which it was used to display previously, the display inserts can be rearranged to accommodate the different product as desired.

The magnetic characteristics of the top surface of the display tray may be effected in a number of different ways. For example, the top surface may be formed by a panel that is itself formed of a magnetic material (i.e., a material that is attracted to a magnetic field, such as, for example, a magnet or a ferromagnetic material such as iron or steel). Also for example, the tray may include a magnetic system positioned beneath the top surface, and thereby hidden from view.

The magnetic system may include magnetic structures such as panels or bars formed of magnetic material extending beneath the top surface. The magnetic structures of the magnetic system may be varied widely in position and configuration to create individual magnetic nodes or zones on the top surface (e.g., in a pattern), or an entirely magnetic surface, to interact with magnetic inserts as desired. In this way, in some embodiments the display tray can be configured to allow magnetic inserts to be positioned anywhere on the top surface (e.g., by using a magnetic plate beneath the entirety of the top surface). In this way, in other embodiments the display tray can be configured to help control the position of the magnetic inserts into predetermined positions aligning with magnetic bars or magnetic plates positioned only under certain portions of the top surface. This can help in recreating repeated or regularly-incremented positioning of the magnetic inserts, which can help make them more visually appealing especially in the case where there are several display trays that are intended to have the same or a similar configuration of display inserts.

The strength of coupling (e.g., magnetic coupling) between the display inserts and the display tray top surface can be tuned to achieve a desired strength that is strong enough to hold the product in place but weak enough to allow a user to reposition the display inserts by hand without the need for tools or other aids. The strength can be tuned, for example, by the selection of magnets (e.g., size and strength) and the position of the magnet and magnetic features relative to the top surface of the display tray.

In some embodiments, as described above and elsewhere herein, the magnetic display inserts include magnets (e.g., permanent magnets or electromagnets) and the display tray includes a magnetic system or other structures that are formed of a magnetic material for magnetically coupling with the magnetic display inserts. It is to be understood that in any of the embodiments described herein this configuration could be reversed (i.e., the magnetic display inserts may be formed of a magnetic material and the display tray may include magnets forming the magnetic system or other structures for magnetically coupling with the magnetic display inserts), or both features can include magnets (i.e., the magnetic display inserts may include magnets and the display tray may include magnets forming the magnetic system or other structures for magnetically coupling with the magnetic display inserts).

The display trays described herein can be used in a variety of contexts. For example, it may be a self-contained unit that can be carried around (e.g., by a retail clerk) and placed in different locations as desired (e.g., on a table in a retail store to showcase displayed products to a customer). Also for example, the display tray may be mounted to or otherwise integrated in a surface, such as a vertical surface like wall or horizontal surface like a table top.

In some embodiments, a retail display fixture includes an array of modular product display trays that are slidably connected to a mounting surface. If a user wants to select a specific product, they can slide the product's display tray towards them, extending past the array of display trays and revealing the contents of the selected display tray.

These and other embodiments are discussed below with reference to FIGS. 1-16. However, those skilled in the art will readily appreciate that the detailed description given herein with respect to these Figures is for explanatory purposes only and should not be construed as limiting.

Figure 2:
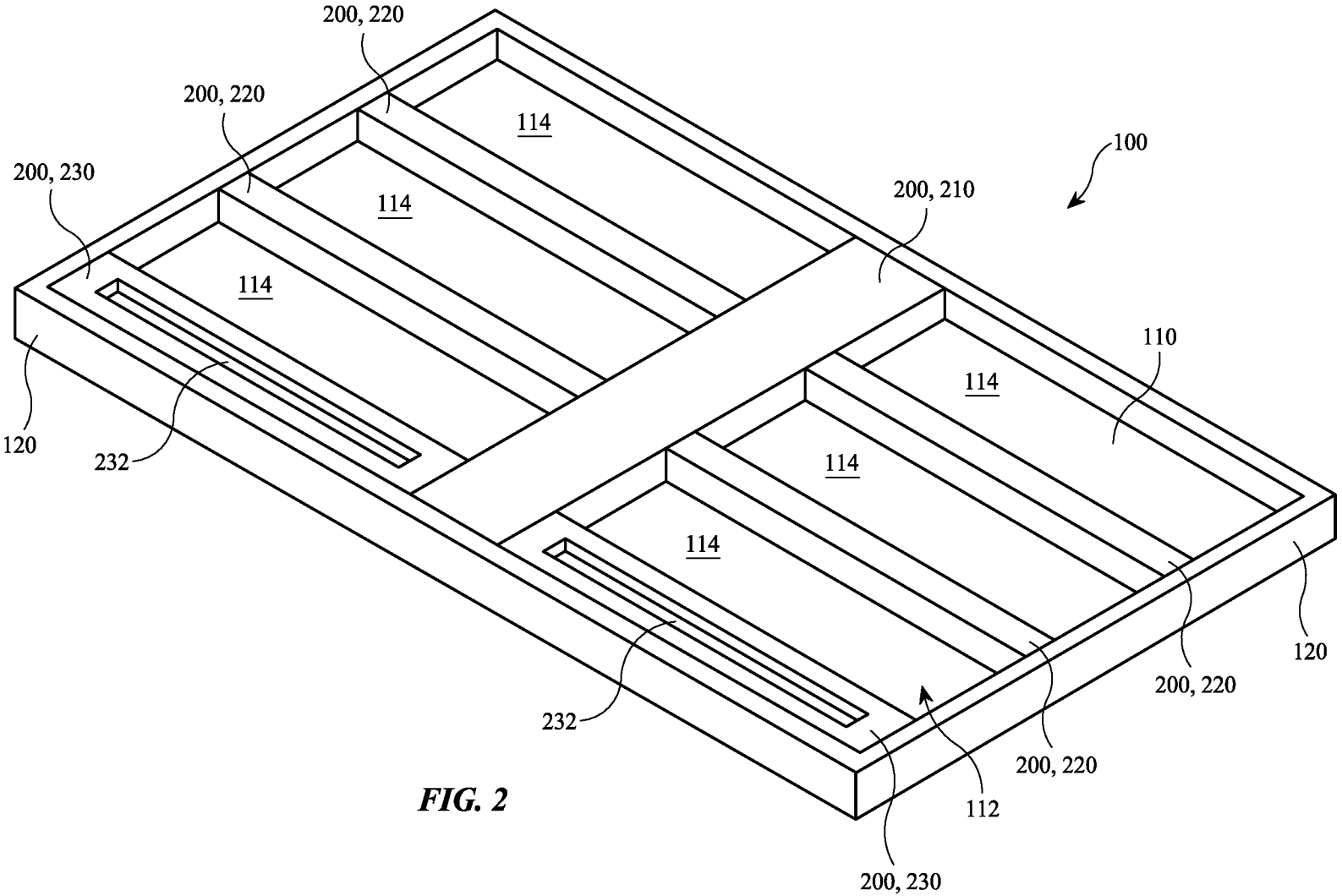
FIG. 2 shows an isometric view of the retail display tray of FIG. 1.

FIGS. 1 and 2 illustrate a product display unit: modular product display tray 100. FIG. 1 shows a top view, FIG. 2 shows an isometric view. As shown, display tray 100 has a top surface 110 surrounded by an apron 120 forming walls around top surface 110. As shown, top surface 110 may be arranged horizontally. Together top surface 110 and apron 120 define a cavity 112, within which display inserts 200 are positioned to define compartments 114 (e.g., product-display compartments for displaying products). Compartments 114 include portions of cavity 112, and are defined by display inserts 200 either alone or in combination with walls of apron 120.

As shown in FIGS. 1 and 2, display inserts 200 can be positioned at in different directions to create compartments 114 (e.g., row dividers 220 extending left-right in FIG. 1 and column divider 210 extending up-down in FIG. 1). Display inserts 200 can have different lengths and widths (compare wider and longer column divider 210 with narrower and shorter row dividers 220). Display inserts 200 can have different shapes, and display inserts 200 having different shapes (or all the same shape) can be used together to create a desired arrangement of product-display compartments 114. To effect a desired arrangement, display inserts 200 can be positioned with their sides parallel or transverse to each other, or even at oblique angles to each other.

Figure 17:
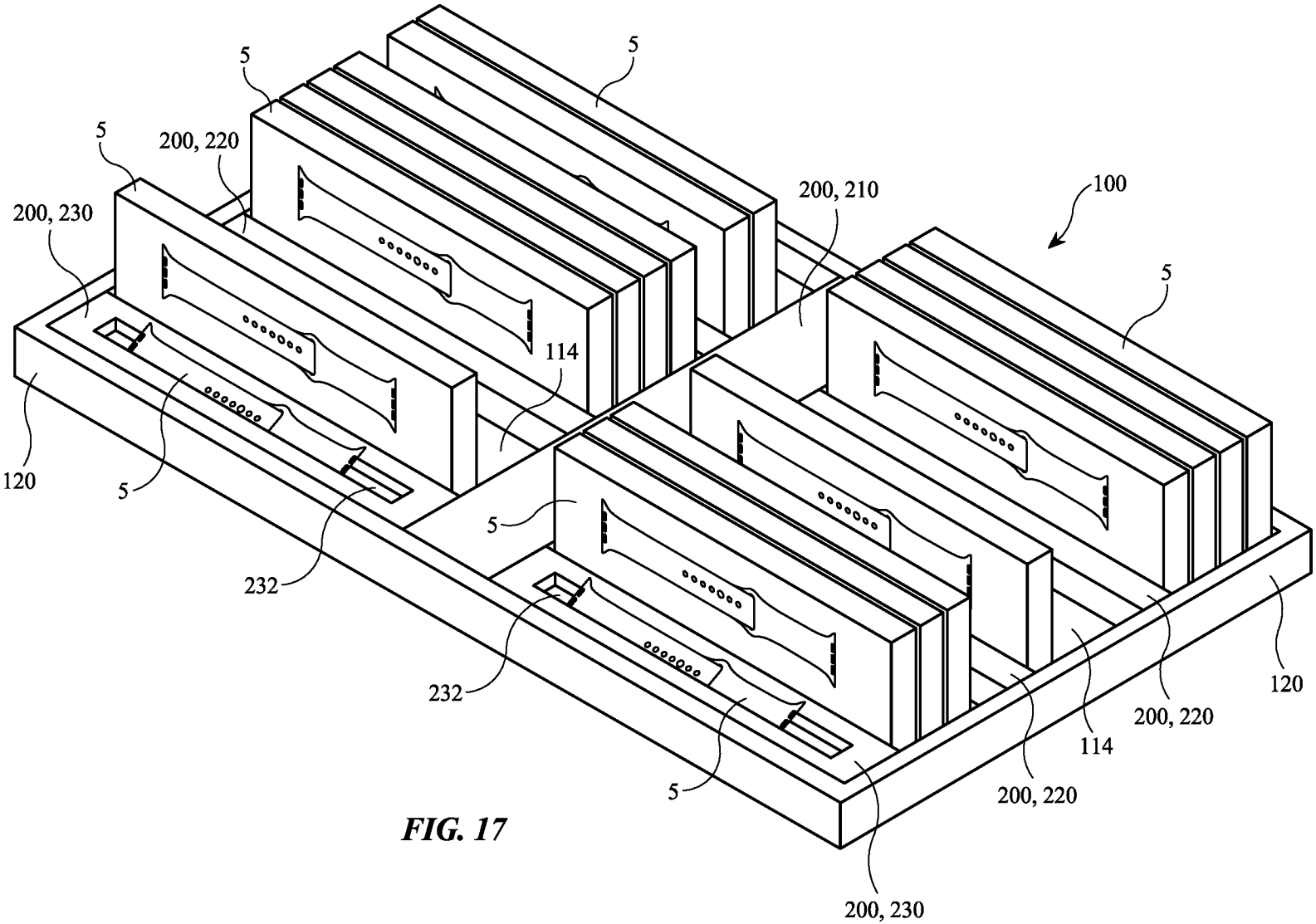
FIG. 17 shows an isometric view of the retail display tray with product.

Display inserts 200 can have additional features, such as a product stands or sign. For example, groove 232 in product stand insert 230 can be used for receiving a display-model product 5 (e.g., an unpackaged product), such as is shown in FIG. 17. FIG. 17 shows an example of how display tray 100 may be used, with product 5 being positioned within compartments 114 that fit the bottom portions of products 5 closely so as to give them a clear position to be consistently stocked in. This also helps to maintain stocked products 5 in such position during use. If differently-shaped products 5 are to be stocked in display tray 100, display inserts 200 can be reconfigured to similarly closely fit around the new product shapes.

Figure 3:
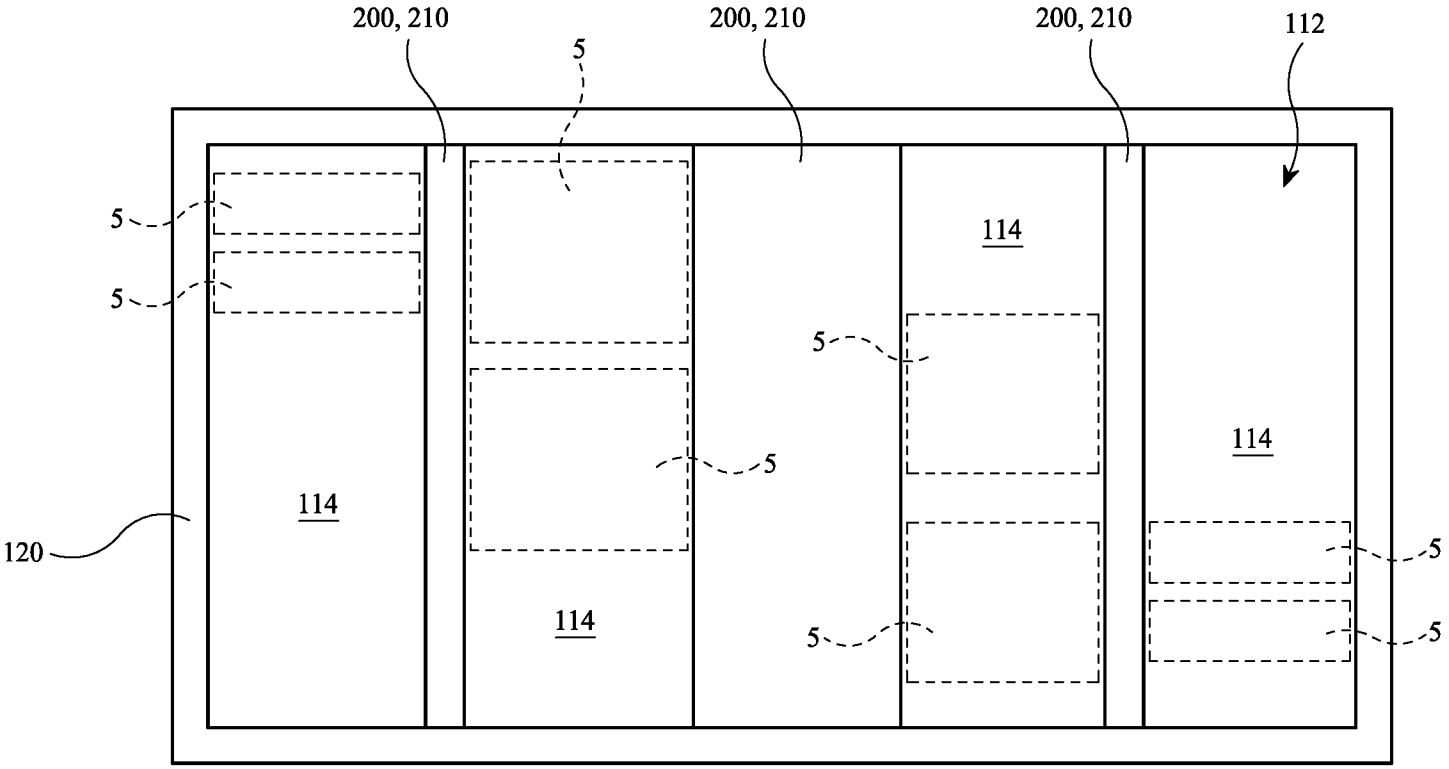
FIG. 3 shows a top view of the retail display tray of FIG. 1 in a different configuration.
Figure 4:
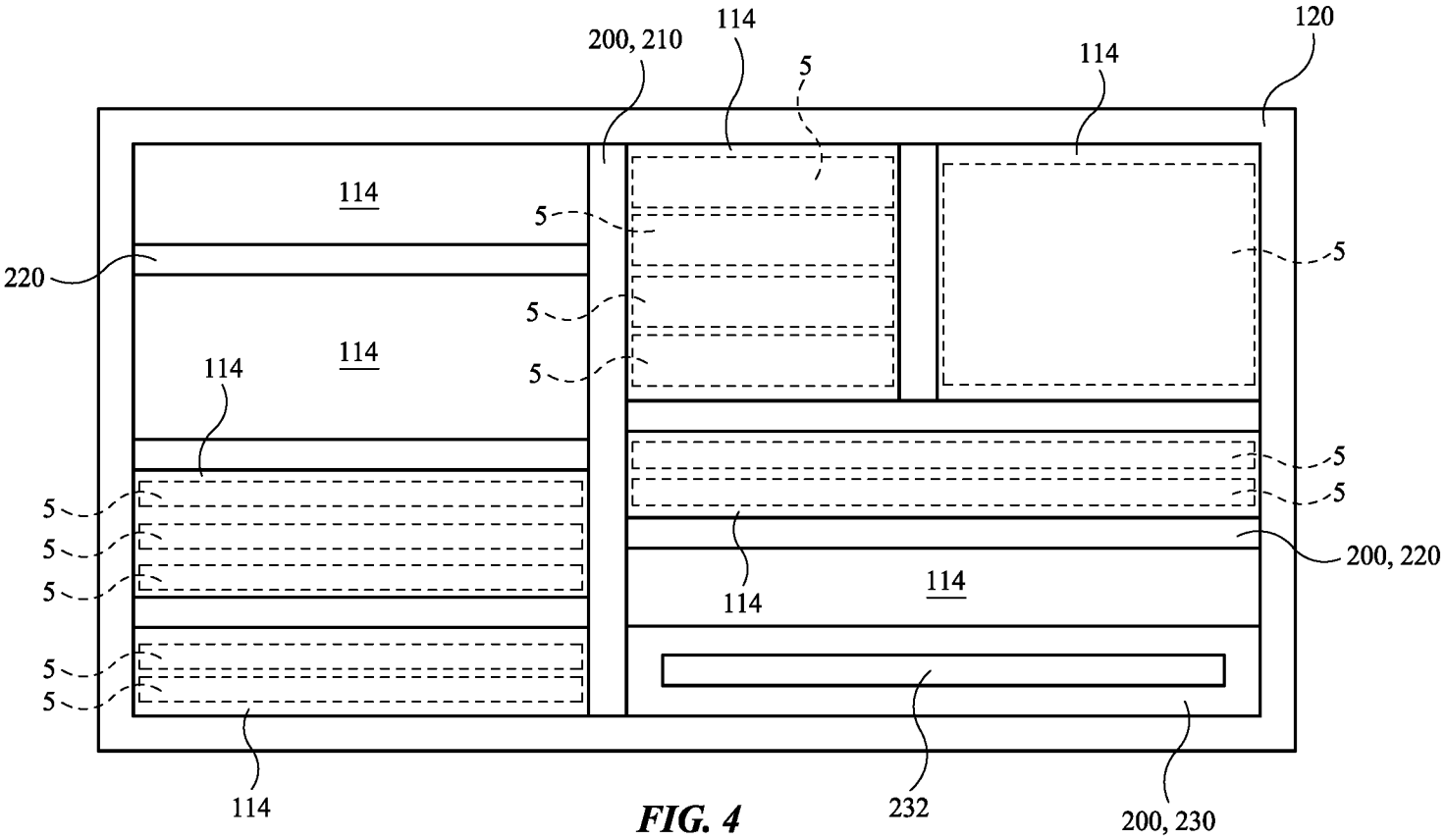
FIG. 4 shows a top view of the retail display tray of FIG. 1 in a different configuration.

Display inserts 200 can be reconfigured including by being repositioned within cavity 112, removed from cavity 112, replaced by other display inserts, or any combination of these. FIGS. 3 and 4 show example alternative arrangements of display inserts 200 for accommodating different sizes and shapes of products 5. In some embodiments, as shown for example in FIG. 3, display tray 100 may include only column dividers 210. In some embodiments display tray 100 may include only row dividers. In some embodiments, as shown for example in FIGS. 2 and 4, display tray 100 may include a combination of column dividers 210, row dividers 220, and product stand inserts 230 to create custom compartments 114. The configurations shown in FIGS. 3 and 4 show example ways that display inserts 200 can be reconfigured within the same display tray 100. It is to be understood that the modular nature of display tray 100 and display inserts 200 could be used to create many different other configurations to suit particular purposes.

As will be explained in greater detail, display inserts 200 may be removably coupled to top surface 110 to facilitate their easy reconfiguration (e.g., by a store clerk to account for changes in stock or different products to be displayed).

Embodiments of display tray 100 can be used in a variety of contexts. For example, display tray 100 may be a mobile, self-contained unit that can be carried around (e.g., by a retail clerk) and used or placed in different locations as desired (e.g., on a table in a retail store to showcase displayed products to a customer). Also for example, display tray 100 may be mounted to or integrated in a surface, such as a vertical surface like wall or horizontal surface like a table top.

In the case of a horizontal surface such as a table top, for example, display tray 100 may be integrated into the table top (e.g., built into and forming part of the table top, or otherwise fixed to the table top) for ready view and access by a customer. In some embodiments display tray 100 may be removably attached to the table top, e.g., via magnets or mechanical fasteners such as screws, bolts, or latches, for example.

Figure 5:
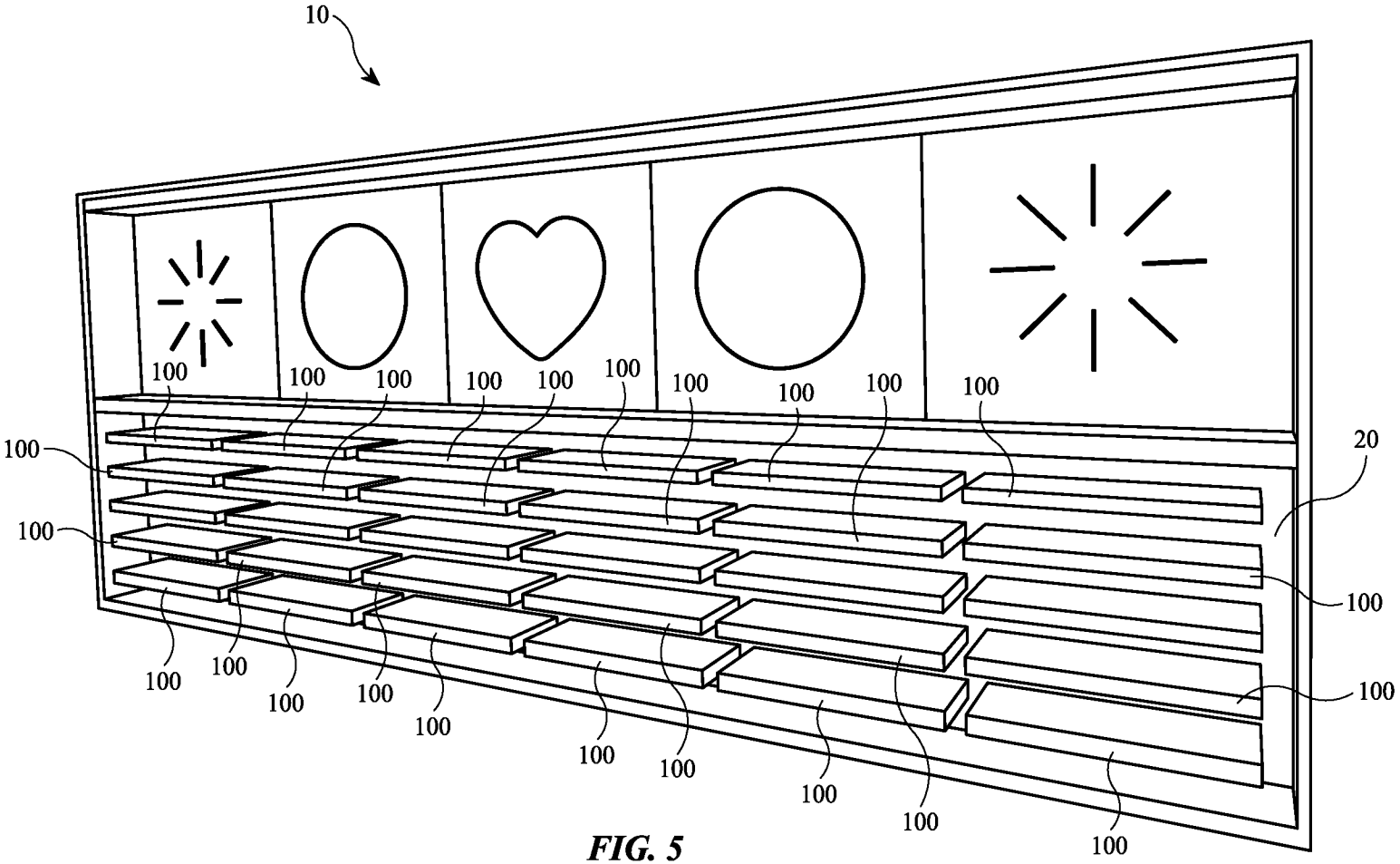
FIG. 5 shows a perspective view of a retail display fixture including the retail display tray of FIG. 1.
Figure 6:
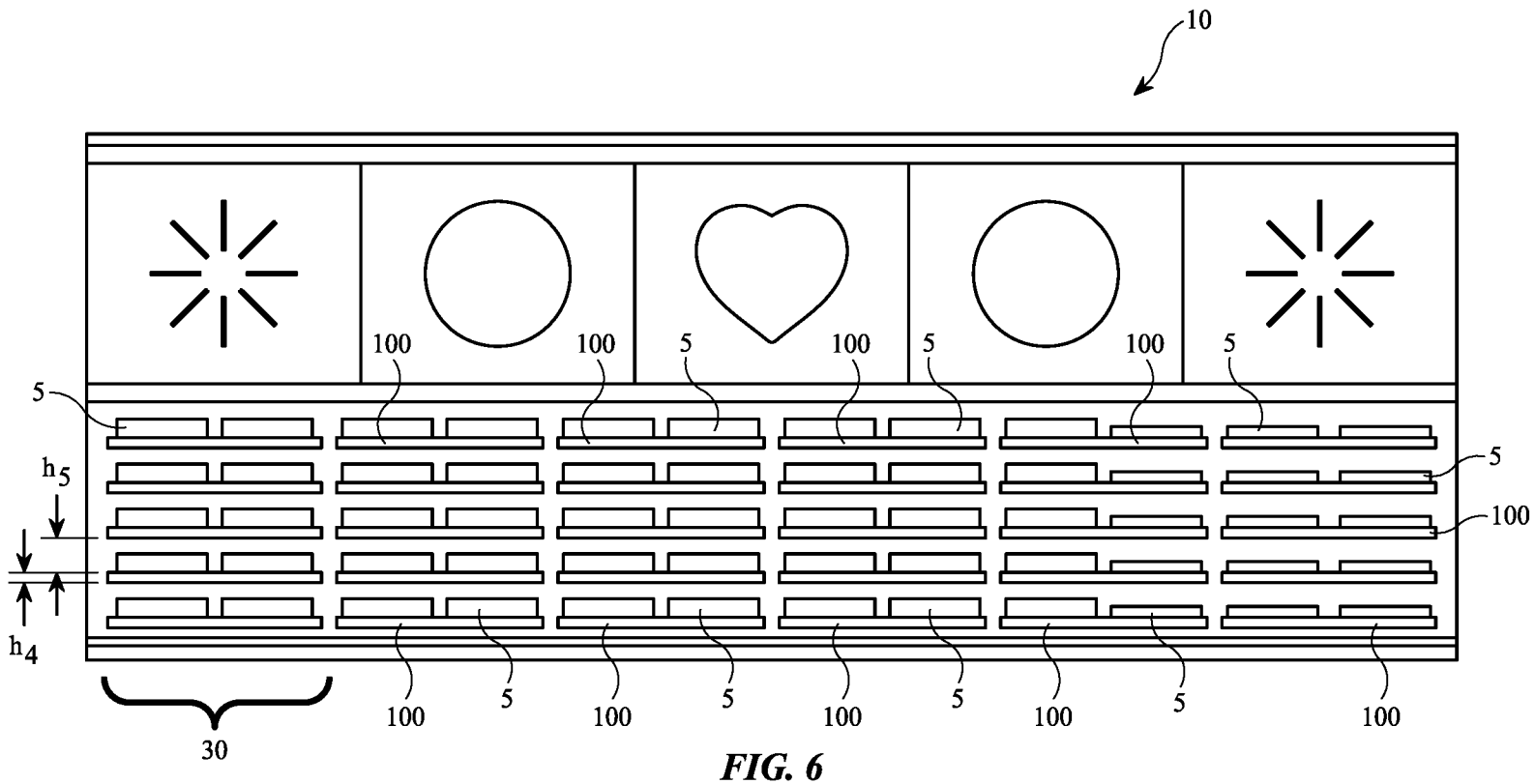
FIG. 6 shows a front view of the retail display fixture of FIG. 5.
Figure 7:
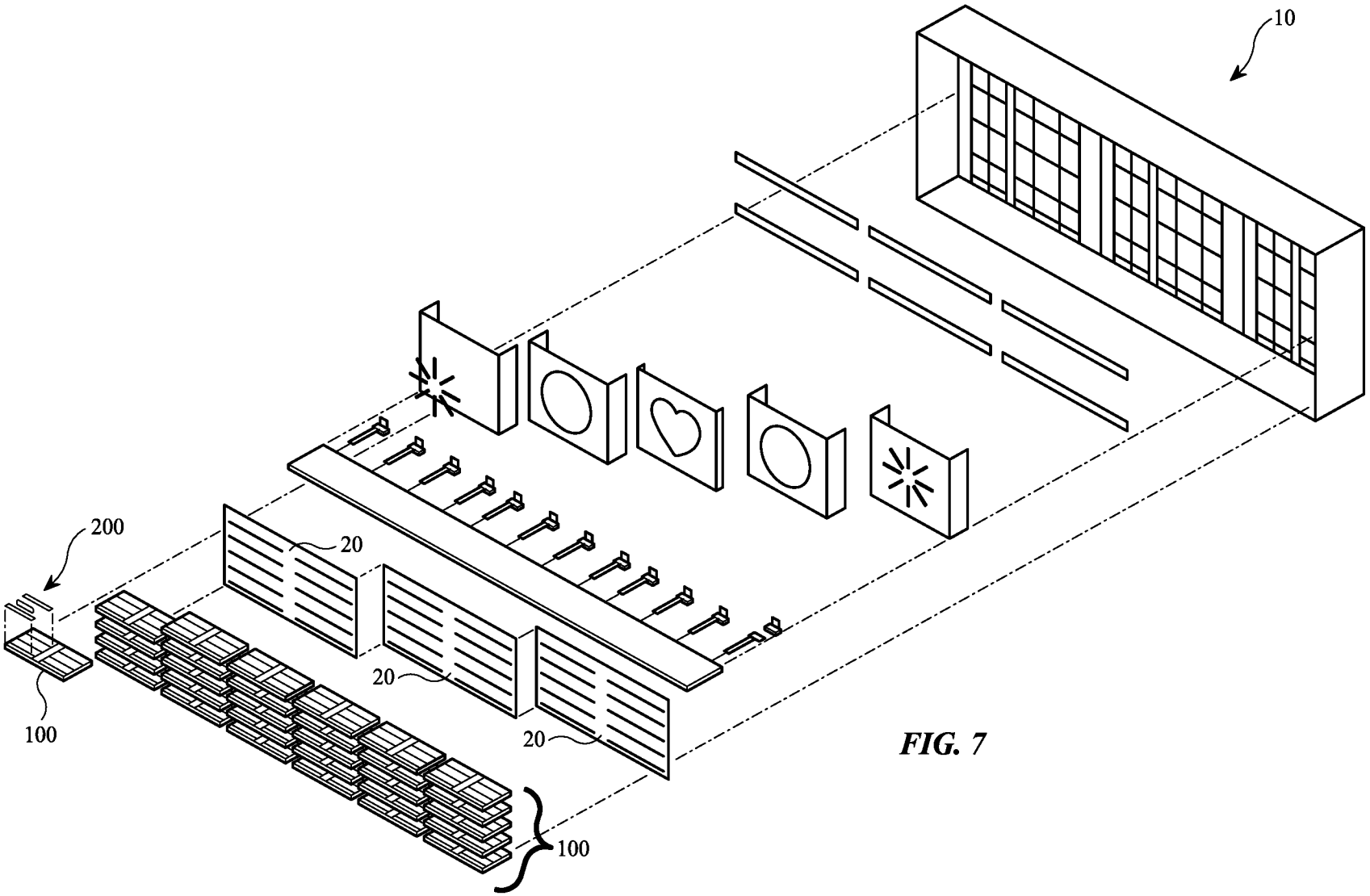
FIG. 7 shows an exploded view of the retail display fixture of FIG. 5.

In the case of a vertical surface such as wall, for example, the wall may be part of a larger display unit, such as, for example, retail display fixture 10 shown in FIGS. 5-7. FIG. 5 shows a perspective view of retail display fixture 10 incorporating an array of product display trays 100 (e.g., in a column-and-row configuration as shown in FIGS. 5 and 6, or in a column configuration as in one of the columns (e.g., column 30) of product display trays shown in FIGS. 5 and 6). FIG. 6 shows a front view of retail display fixture 10 including product 5 displayed on product display trays 100. Product 5 may be a packaged product that a customer may take and purchase. FIG. 17 shows an isometric view of a single product display tray 100 including packaged product 5 and displayed product 5. From these images, it can be appreciated how cavities 112 can help maintain and present product 5 in a regular, desired arrangement, which can create a clean, organized visual appearance that gives the viewer a positive impression.

In some embodiments, such as is shown in FIGS. 5-7, a display tray 100 may be mounted to a support structure such as a wall (e.g., support structure/wall 20 of retail display fixture 10) in a cantilevered configuration. FIG. 7 shows the arrangement of display trays 100 relative to support structures/walls 20 of retail display fixture 100 in an exploded configuration. In some embodiments, to make efficient use of space, multiple display trays 100 may be arranged together in this way, creating an array of cantilevered display trays 100, such as is shown in FIGS. 5 and 6. To further enhance spatial efficiency, display trays 100 may have a low profile.

Display trays 100 in a column (e.g., column 30 as shown in FIG. 6) may be spaced apart from one another to allow for efficient usage of space while still enabling access to products 5. For example, each display tray 100 in column 30 may be vertically spaced apart from an adjacent display tray 100 in column 30 such that a height $h_5$ of the vertical space between the adjacent display trays 100 is between 1 and 5 times (e.g., 3 times) a height $h_4$ of the display tray 100.

To promote easier access to such display trays 100, they may be mounted to support structure 20 and slidable away from and toward support structure 20 (e.g., configured as a product display drawer 100), which may increase the visibility and accessibility of displayed products 5 to a customer. If a user wants to select a specific product 5, they can slide that product 5's display tray 100 towards them, extending past the other display trays 100 in the array and revealing the contents of the selected display tray 100. In some such embodiments, product display tray 100 may include a movable (e.g., slidable) support connecting to the wall, such as one or more drawer slides, for example. This configuration can allow display tray 100 to be pulled outward away from support structure 20 (e.g., wall 20 of product display fixture 10) by a customer or other user while the customer is examining or accessing displayed products 5, and then to be pushed back toward support structure 20 to stow display tray 100 until the next user wants to access it.

Figure 8:
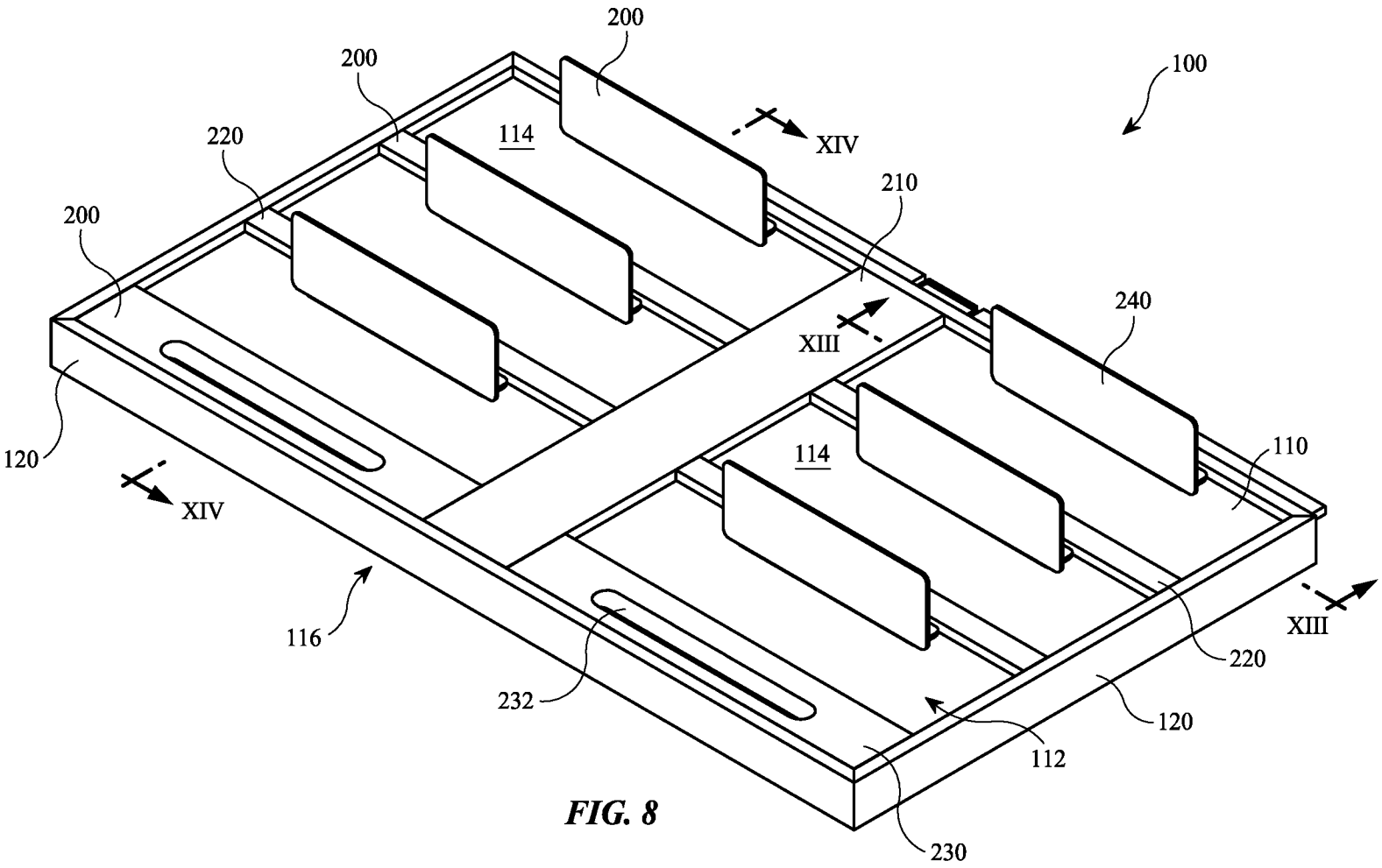
FIG. 8 shows an isometric view of the retail display tray.

FIG. 8 shows modular product display tray 100 with a further type of display insert 200: product backer 240. Product backers 240 may couple to product display tray 100 in the same manner as other display inserts 200. Display inserts 200 may be coupled to top surface 110 via a retention mechanism without any visible attachment mechanism or hardware. Display inserts 200 will appear to a viewer to simply be positioned at their locations with no visible slots, screws, latches, adhesive, or other attachment features. In some embodiments, display inserts 200 are coupled to top surface 110 via a magnetic connection. For example display inserts 200 may include magnets, and display tray 100 may include magnetic materials beneath top surface 110 (or top surface 110 may be formed of a magnetic material) that will attract the magnets of display inserts 200. The magnetic connection between display inserts 200 and top surface 110 may be strong enough to keep display inserts 200 in place during use, but weak enough that a user can overcome the connection by hand to reconfigure display inserts as desired. In other embodiments display inserts 200 may be coupled to top surface 110 in other ways, for example, by friction or pressure created between inserts 200 and the apron 120. Some embodiments may use a combination of magnetic and non-magnetic retention mechanisms.

As shown in FIG. 8, top surface 110 of display tray 100 may be magnetic, and may include a cavity 112 to store products within display tray 100. Cavity 112 (and compartments 114 within cavity 112) has a depth $d_1$ (labeled in FIG. 13) that allows display tray 100 to store products partially within the compartments 114, while maintaining a low profile view for display tray 100 and allowing the products to extend up above compartments 114 (i.e., above a height of display inserts 200 or a height of apron 120 above top surface 110), for display to a customer. In some embodiments, the length and width of the compartments can range from 5 to 40 times the size of the depth $d_1$. In some embodiments, at least one of a length or width of at least one of compartments 114 is at least 10 times its depth $d_1$. In some embodiments, at least one of a length or width of at least one of compartments 114 is at least 20 times its depth $d_1$.

Figure 9:
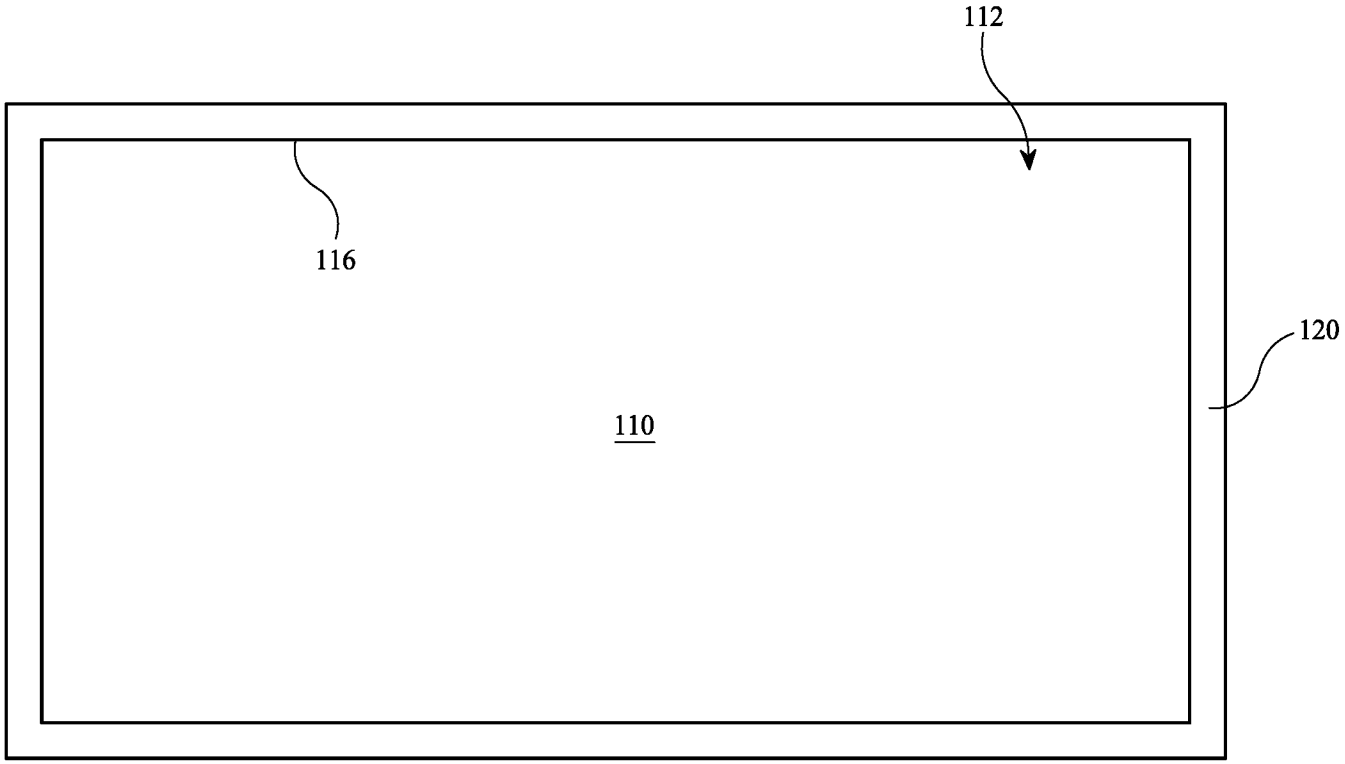
FIG. 9 shows a top view of the retail display tray without inserts.

FIG. 9 shows a top view of display tray 100 without display inserts 200. As shown, cavity 112 is surrounded by apron 120. In some embodiments, apron 120 extends around the entire perimeter 116 of cavity 112. In some embodiments, apron 120 extends partially around perimeter 116 of cavity 112. In some embodiments apron 120 forms a raised lip that extends around top surface 110. In some embodiments, apron 120 has a depression or handle 142 disposed on its bottom surface 140 (see e.g., FIGS. 14-16), which can provide an ergonomic grip for a user to pull or extend display tray 100 out from a stowed position (e.g., as described above). In some embodiments, apron 120 is not magnetic. In other embodiments apron 120 is magnetic forming magnetic inner walls around the periphery of top surface 110 to which display inserts 200 may magnetically couple. Some embodiments do not include an apron. In such embodiments display inserts 200 may be used to perform the functions of an apron.

In some embodiments, display tray 100 includes a magnetic structure (e.g., magnetic layer 130 described in more detail below). The magnetic structure may form top surface 110, or may be positioned just below top surface 110 to make top surface 110 act magnetic such that magnets are attracted toward it. In some embodiments, the magnetic structure may be positioned underneath top surface 110. The magnetic structure is attractable to magnets (e.g., made of a ferrous material such as iron, iron alloys, or steel). In some embodiments, display tray 100 includes a laminate cover (e.g., laminate cover 150 described in more detail below) to conceal magnetic layer 130.

Figure 10:
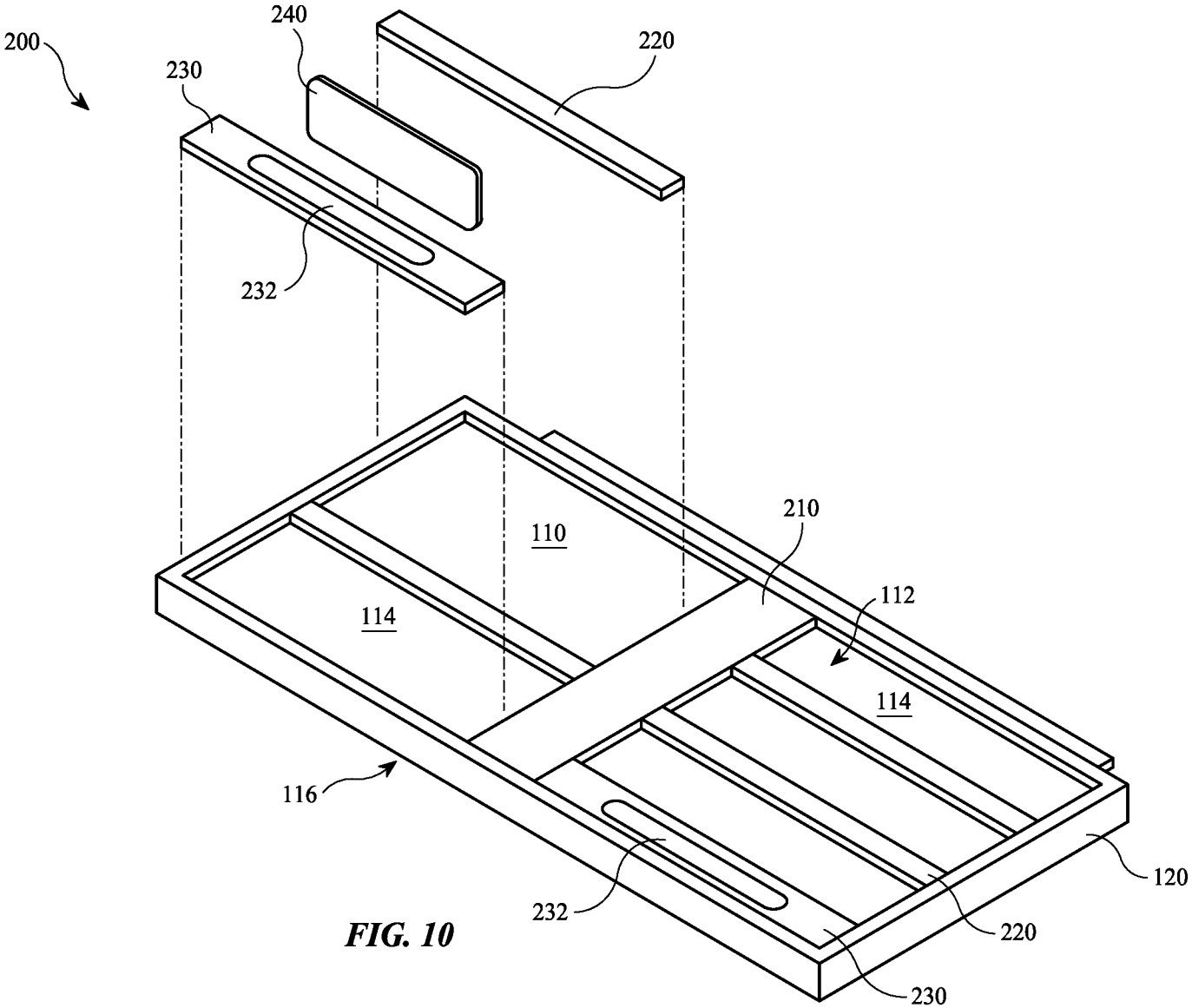
FIG. 10 shows an isometric view of the retail display tray with some inserts removed.

FIG. 10 shows display tray 100 with some display inserts 200 installed, and some separated from cavity 112 above where they may be installed. As discussed above, in some embodiments, display tray 100 may include one or more display inserts 200. As shown for example, in FIG. 10, display inserts 200 may be disposed within cavity 112 to form compartments 114 within cavity 112. In this way, display inserts 200 and apron 120 form walls of compartments 114 and top surface 110 forms floors of compartments 114.

In some embodiments, display inserts 200 include column dividers 210, row dividers 220, product stand inserts 230, and product backers 240. Display inserts 200 may magnetically couple with top surface 110 of display tray 100. Such magnetic connection can allow display inserts 200 to be securely attached to top surface 110 so that they can define compartments 114 and help maintain the positions of products within those compartments 114, while still allowing display inserts 200 to be easily reconfigured. Display inserts 200 can magnetically couple with top surface 110 without mechanical fasteners such as latches, screws, or other mechanical mechanisms, thus further simplifying their installation and reconfiguration. In some embodiments, positions of display inserts 200 are constrained only by apron 120 or other display inserts 200.

Figure 11:
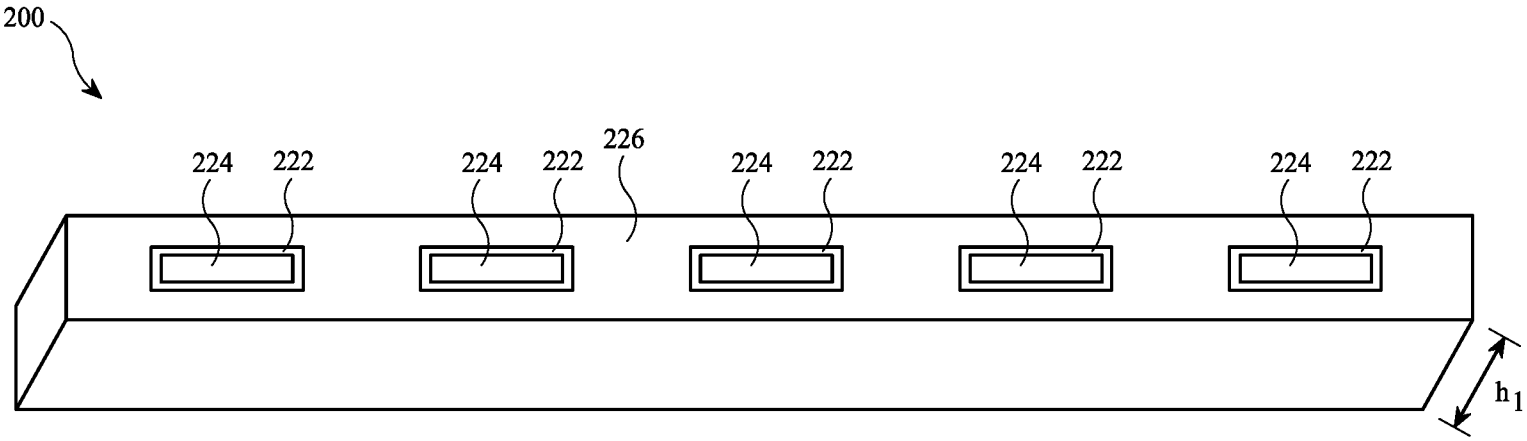
FIG. 11 shows an isometric underside view of a display insert.

In some embodiments, column and row dividers 210, 220 are thin members configured to separate cavity 112 into one or more compartments 114. In some embodiments, dividers 210, 220 may be rectangular, square, triangular, circular, or polygonal to accommodate for a wide array of product dimensions. As shown in FIG. 11, which depicts an example display insert 200 in isolation seen from its bottom side, in some embodiments, display inserts 200 include a depression 222 on a bottom surface 226 thereof. Depression 222 may house a magnet 224, which is how display inserts 200 magnetically couple to top surface 110 as described. In some embodiments, display inserts 200 include a plurality of depressions 222, each housing a magnet 224. In some embodiments, magnet 224 is a permanent magnet (e.g. a rare earth magnet, such as a neodymium magnet). In some embodiments, magnet 224 is display insert 200 itself.

Display inserts 200 have a height $h_1$. In some embodiments, height $h_1$ is less than or equal to depth $d_1$ of cavity 112. This configuration creates a clean profile view of the display tray 100. In some embodiments, however, height $h_1$ can be greater than depth $d_1$, which can provide for greater stability or a more separated appearance for compartments 114.

In some embodiments, product stand inserts 230 (see, e.g., FIG. 10) include a thin member having a groove 232 configured to position a product in an upright or display position. In some embodiments, groove 232 may be a slot or depression. In some embodiments, product stand inserts 230 have a height $h_2$ (labeled in FIG. 14). In some embodiments, height $h_2$ is less than or equal to the depth $d_1$ of cavity 112. This configuration creates a clean profile view of the display tray 100. In some embodiments, however, height $h_2$ can be greater than depth $d_1$, which can provide for greater stability or a more defined appearance for product stand insert or compartments 114.

Figure 13:
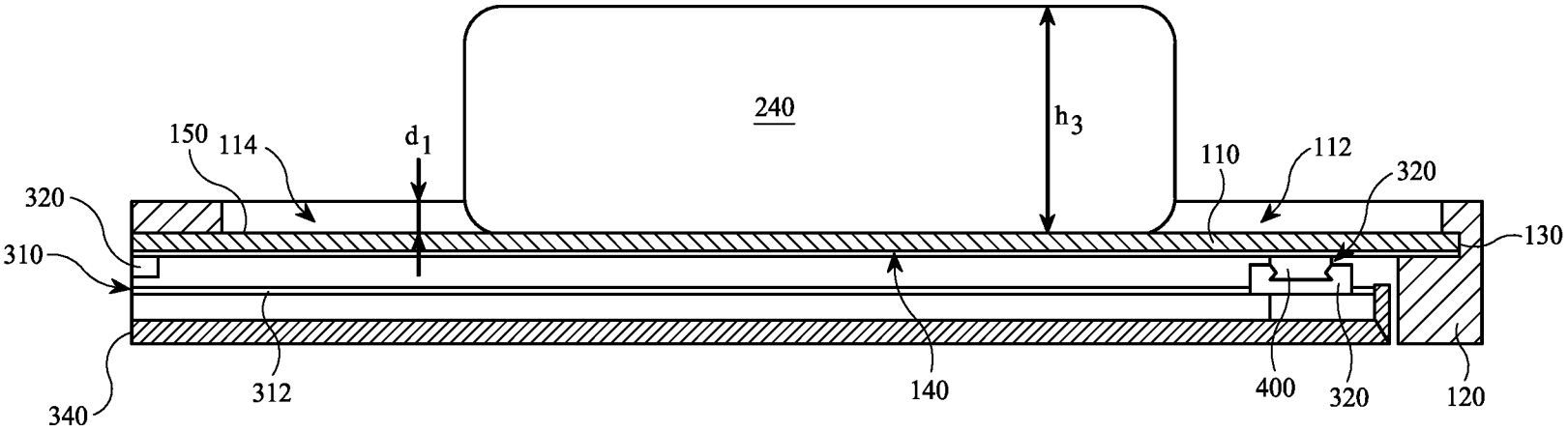
FIG. 13 shows a section view of the retail display tray taken at line XIII-XIII in FIG. 8.
Figure 14:
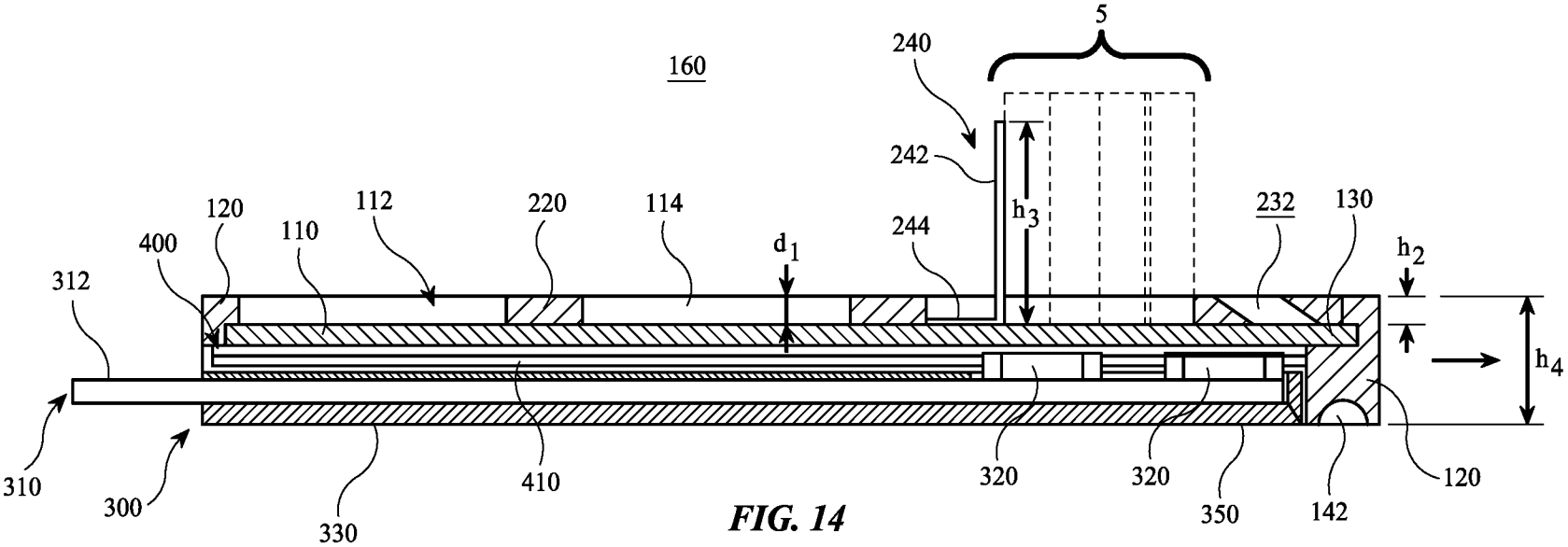
FIG. 14 shows a section view of the retail display tray taken at line XIV-XIV in FIG. 8.
Figure 15:
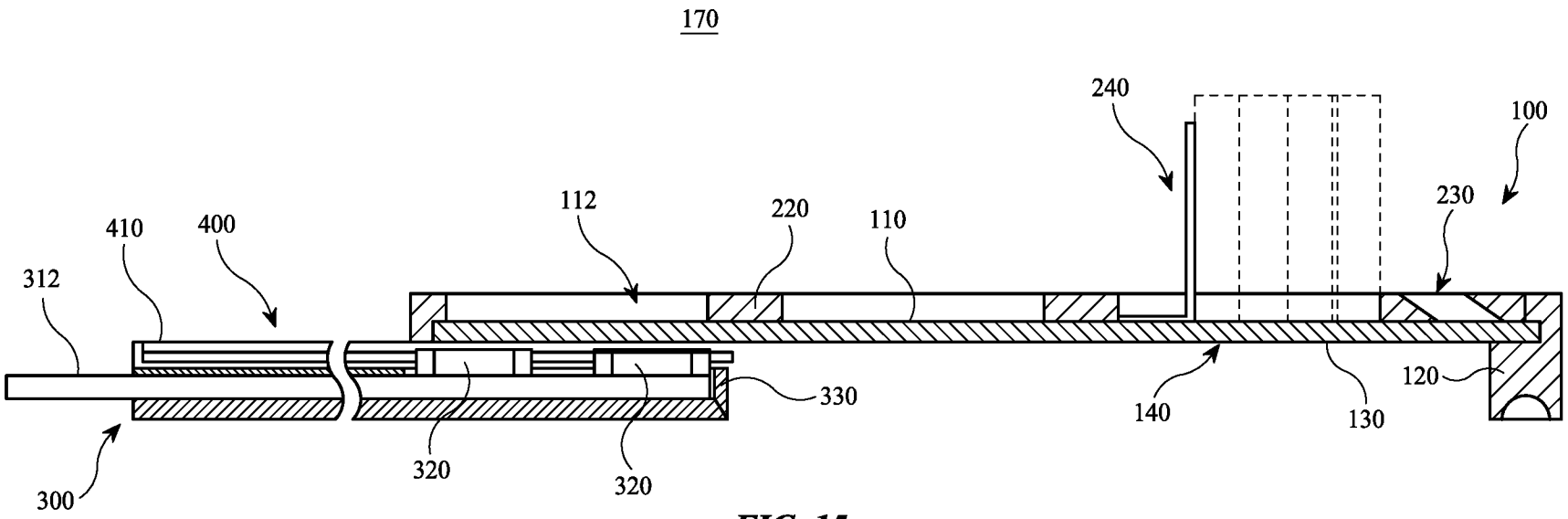
FIG. 15 shows the section view of FIG. 14 with the retail display tray in an extended configuration.
Figure 16:
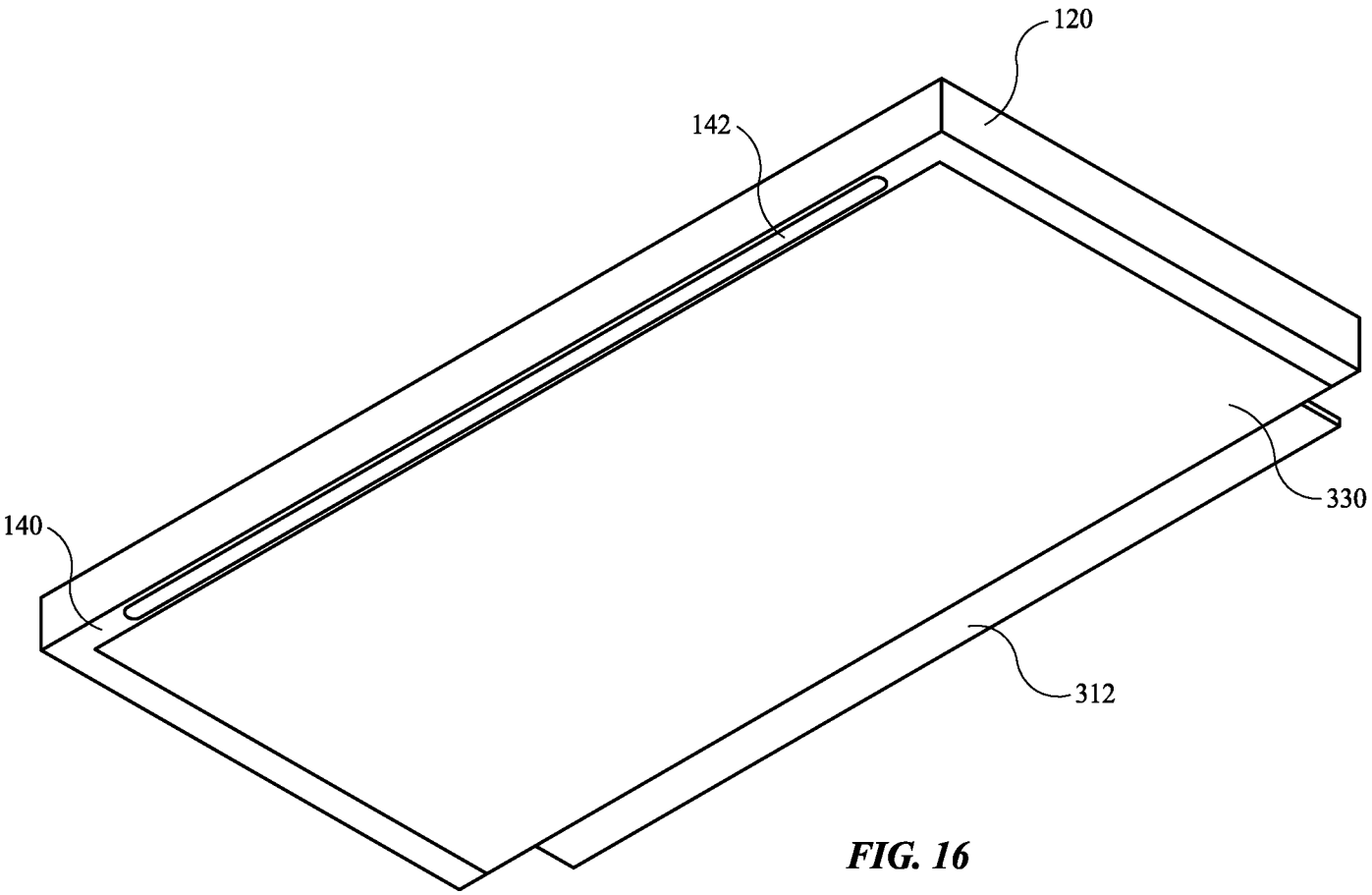
FIG. 16 shows an isometric underside view of the retail display tray.

FIGS. 13-15 show sectional views of display tray 100. The view of FIG. 13 is taken along line XIII-XIII in FIG. 8. The view of FIG. 14 is taken along line XIV-XIV in FIG. 8. FIG. 15 shows the view of FIG. 14 with display tray 100 in an extended position.

In some embodiments, for example, as shown in FIGS. 13 and 14, product backers 240 include an upright support member 242 and base support member 244. Upright support member 242 is configured to retain products 5 (e.g., packaged product 5) in an upright position within a compartment 114. For example, when a user removes one of products 5, which product backer 240 is supporting, a user can reposition product backer 240 closer to the remaining products 5 to provide adequate support for products 5 to remain in the upright position (e.g., an upright position as shown, for example, in FIG. 14, 15, or 17, where a height of the product, such as packaged product 5, is greater than its depth, such as more than two times greater, more than four times greater, or between three and six times greater). For example, due to the magnetic connection between product backer 240 and top surface 110, product backer 240 may be slidable within its compartment 114 without decoupling from top surface 110. A user may thus slide product backer 240 to a new position to maintain adequate support for products 5 when stock levels of product 5 change within the compartment. This process can be repeated each time a product 5 is removed from (or added to) the display tray 100. Just as with other display inserts 200, product backers 240 may be magnetically coupled to top surface 110. In some embodiments the strength of magnetic connection between product backers 240 and top surface 110 is weaker than the magnetic connection of other types of display inserts 200 that are used to form compartments 114 (e.g., column dividers 210, row dividers 220, product stand inserts 230) and top surface 110 because product backers 240 may be more routinely repositioned to account for diminished or replenished stock within a compartment 114.

In some embodiments product backer 240 may have multiple upright support members 242 coupled to base support member 244. In such embodiments the multiple upright support members 242 may be parallel to each other and spaced apart by a gap distance. The gap distance may be, for example, the same as a depth of product 5 that is to be held by product backer 240 in the gap between adjacent upright support members. In this way, multiple products 5 can be held in a row by product backer 240, each between adjacent upright support members 242. For example, product backer 240 may include six upright support members 242 extending upward from base support member 244, thereby creating five gaps between upright support members 242 for holding five products 5. In some embodiments two outer upright support members 242 may extend upwardly from opposing edges of base support member 244, such that base support member 244 extends between the two outer upright support members 242, and additional upright support members 242 may be evenly spaced between outer support members 242, each extending upward from base support member 244. A product backer 240 including multiple upright support members 242 as described may have a comb-like side profile. A product backer 240 including multiple upright support members 242 as described may be useful to help maintain consistent and repeatable positioning of products 5 and provide a clear indication of the appropriate position for product 5. A product backer 240 including multiple upright support members 242 as described may also allow reduction and replenishment of product 5 stock in upright positions without the need to reposition product backer 240.

In some embodiments, upright support member 242 has a height $h_3$ (as shown in FIG. 14) that is less than or equal to a height of its respective retained product (including any retail product packaging). This configuration (e.g., as shown in FIG. 14 with respect to product 5) allows the product to conceal product backers 240 from the view of the customer, which increases the aesthetics of the display tray 100. In some embodiments, however, height $h_3$ can be greater than the height of retained product 5, which can provide for greater separation between compartments 114 or an increased labeling opportunity (e.g., in the event that a label or other graphic of interest is included on upright support member 242). In some embodiments, base support member 244 is magnetic to couple to the top surface 110 of display tray 100.

In some embodiments, display tray 100 may include one or more types of display inserts 200 in any desired combination (e.g., column dividers 210, row dividers 220, product stand inserts 230, and product backers 240). Although column dividers 210 and row dividers 220 are shown and described as being oriented in a specific way, because of the modular design of the display tray 100, dividers 210 and 220 can be oriented in different directions (e.g., in the column direction, row direction, or diagonally).

Display inserts 200 are removably coupled to top surface 110 and can be rearranged within cavity 112 as desired. For example, display tray 100 may be initially configured as shown in FIG. 9, where cavity 112 does not include any display inserts 200. This configuration allows products to be placed freely within cavity 112, where the products are unsecured and capable of sliding around during movement of display tray 100. As shown, for example, in FIG. 10, a user can place display inserts 200 within cavity 112 to define compartments 114. In this example two columns and three rows of long, rectangular compartments 114 are formed, with product stand inserts 230 in front of each column. Such an arrangement may be useful for, for example, displaying a product (e.g., a watch band) on product stand insert 230, and storing and displaying boxes containing similar watch bands in each row for a customer to access and take for purchase, such as is shown in FIGS. 5 and 6, for example.

To effect such magnetic coupling and repositioning, top surface 110 may be magnetic, as discussed. As shown in FIGS. 13 and 14, for example, top surface may be a surface of magnetic structure 130, which may itself be formed of a magnetic material. In some embodiments, top surface 110 is formed by a laminate cover 150 disposed over magnetic structure 130. Laminate cover 150 may or may not itself be formed of a magnetic material (e.g., it may be a wood veneer for appearance), but will act with magnetic properties due to underlying magnetic structure 130. Magnetic structure 130 may be a uniform panel extending under all of top surface 110 to create a uniform magnetic area within which display inserts 200 can be positioned. In some embodiments, magnetic structure 130 may be formed of distinct magnetic elements, such as panels or bars formed of magnetic material extending beneath top surface 110 (e.g., beneath laminate cover 150). Such magnetic elements of magnetic structure 130 may be varied widely in position and configuration to create individual magnetic nodes or zones on the top surface (e.g., in a pattern), or an entirely magnetic surface (e.g., in the case of a uniform panel), to interact with display inserts 200 as desired. In this way, in some embodiments display tray 100 can be configured to allow display inserts 200 to be positioned and magnetically coupled anywhere on top surface 110 (e.g., by using a magnetic panel beneath the entirety of the top surface). In this way, in other embodiments display tray 100 can be configured to help control the position of display inserts 200 into predetermined positions aligning with magnetic bars or magnetic plates positioned only under certain portions of top surface 110. This can help in recreating repeated or regularly-incremented positioning of the magnetic inserts, which can help make them more visually appealing especially in the case where there are several display trays 100 that are intended to have the same or a similar configuration of display inserts 200.

To accommodate different types of product or different desired retail display scenarios, display inserts 200 can be easily reconfigured. Being magnetically coupled to top surface 110, they can be removed and re-attached in different positions without tools. Further, if new products call for new different shapes or types of display inserts 200, the old display inserts 200 can be removed and replaced with the new display inserts. In this way a product display tray 100 (and retail display fixture 10) can be easily and inexpensively reconfigured without the need to remove or replace significant hardware or structural features.

The strength of coupling (e.g., magnetic coupling) between display inserts 200 and display tray top surface 110 can be tuned to achieve a desired strength that is strong enough to hold display insert 200 and displayed products in place but weak enough to allow a user to reposition display inserts 200 by hand without the need for tools or other aids. The strength can be tuned, for example, by the selection of magnets (e.g., size and strength) and the position of the magnet and magnetic features relative to top surface 110 of the display tray 100.

As mentioned, in some embodiments display tray 100 is slidably coupled to a support structure (e.g., support structure 20 shown in FIGS. 5-7). As shown in FIGS. 12-15, drawer support 300 can allow an individual display tray 100 to be pulled out (e.g., from an array of similar display drawers, see FIGS. 5 and 6) by a user for ease of access. Drawer support 300 includes support member 310, slide connection members 320, and housing 330.

In some embodiments, support member 310 includes a cantilevered support 312 (see FIG. 15) that is removably attached to a mounting surface 20 (see e.g. FIG. 5). Support member 310 provides stability for display tray 100 to extend outwardly along drawer slides 400 while minimizing shaking, wobbling, or deflection of display tray 100 as it extends from a first position (e.g., a retracted position 160, see FIG. 14) to a second position (e.g., an extended position 170, see FIG. 15). In some embodiments, cantilevered support 312 is a rigid member (e.g. wood or aluminum plate). Cantilevered support may be fixed to a support structure (e.g., support structure/wall 20) to hold display tray 100 in a cantilevered position ready for access by a user.

In some embodiments, drawer support 300 includes a slide connection member 320. Slide connection member 320 includes a cavity 322 (see e.g. FIG. 12) to house drawer slides 400. In some embodiments the depth of cavity 322 is less than or equal to a height of drawer slides 400 such that display tray 100 can minimize its thickness and maintain a low profile.

In some embodiments, drawer support 300 includes housing 330 to enclose support member 310 and slide connection member 320. In some embodiments, drawer support 300 includes a laminate cover 350 to provide a uniform aesthetic look for the drawer support 300. In some embodiments, display tray 100 has a uniform aesthetic look (e.g., a wood finish). In some embodiments, top surface 110, apron 120, and drawer support 300 are formed from wood or veneered to appear as wood. In some embodiments, display inserts 200 are formed from wood or veneered to appear as wood. As such, the display tray 100 provides a clean and uniform appearance. In some embodiments, laminate cover 350 is a wood veneer. In other embodiments, these elements can have appearances other than wood in order to have a desired appearance. For example, a composite or upholstered appearance.

Figure 12:
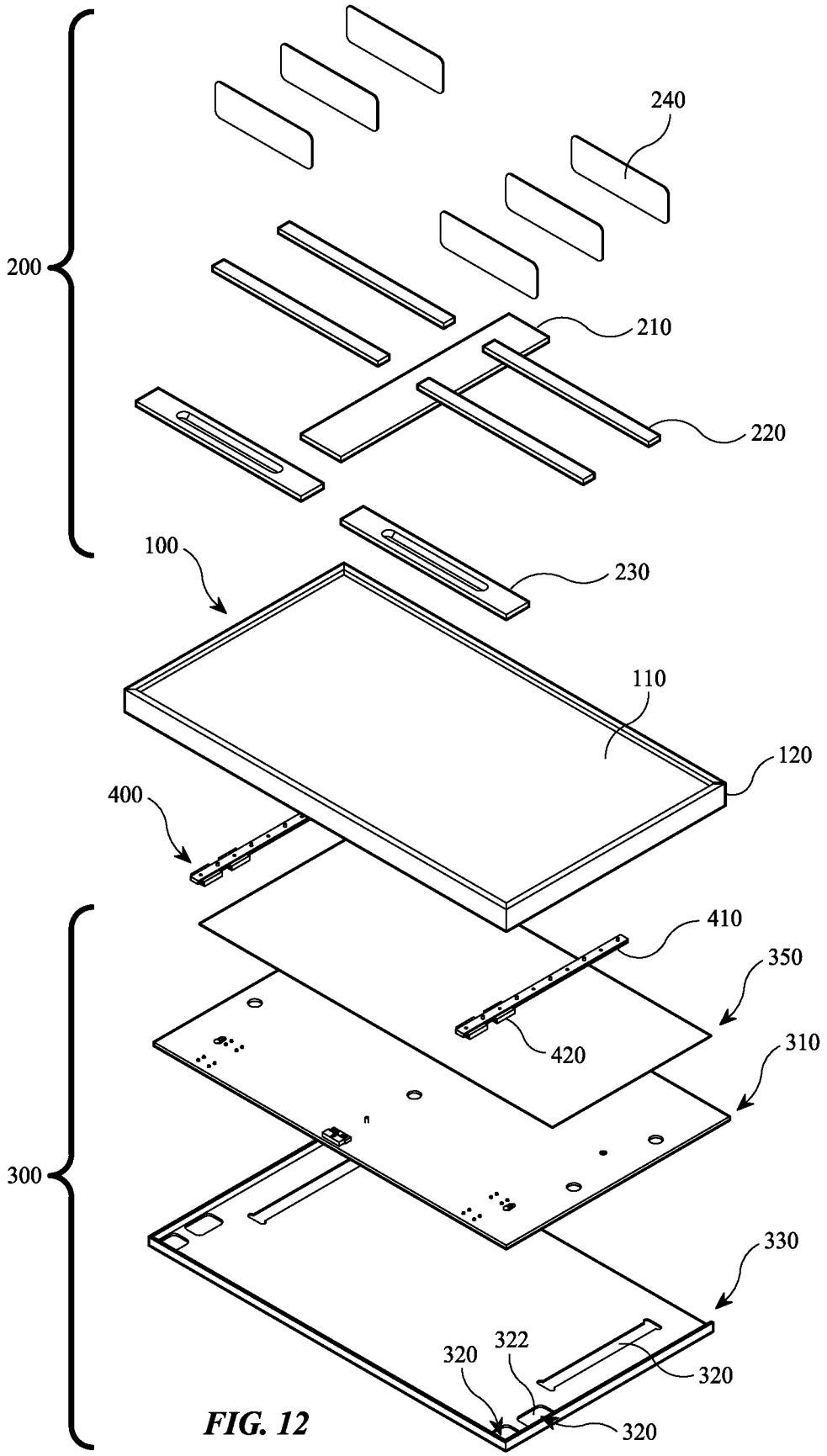
FIG. 12 shows an exploded view of the retail display tray.

Drawer support 300 may be slidably coupled to display tray 100 through drawer slides 400. Drawer slides 400 include track 410 and guides 420. In some embodiments, to achieve a low profile for display tray 100, track 410 may be oriented horizontally, as shown in FIGS. 12 and 15. This differs from upright drawer tracks and provides a more compact slider setup that can be concealed in a compact arrangement. In some embodiments, track 410 may be a telescopic track. In some embodiments, track 410 may be a glide track. Track 410 is positioned along guides 420 (see e.g. FIG. 12). In some embodiments, guides 420 are disposed within cavity 322 of drawer support 300 and disposed within a bottom surface 140 of display tray 100.

As evident by comparing FIGS. 14 and 15, display tray 100 can be moved from a retracted, stowed position 160 in FIG. 14, to an extended position 170 in FIG. 15, sliding on drawer slides 400. A user may operate display tray 100 by pulling display tray 100 via depression or handle 142 positioned on the underside of display tray 100 (e.g., as a depression in apron 120, see FIG. 16), which shows an underside of display tray 100. When the user is done with display tray 100, they may push it back toward its retracted, stowed position 160.

Display tray 100 may be formed of a variety of materials to effect the structure and purposes described herein. For some portions magnetic materials such as metal or magnets are used to effect the magnetic coupling described. Other portions may be formed of a desired finished material to effect a desired appearance, such as wood or plastic. And portions that are formed of metal or magnets to effect their function may be covered by the finished material (e.g., wood veneer) to give them a desired finished appearance while still maintaining their magnetic effectiveness.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not intended to be exhaustive or to limit the embodiments to the precise forms disclosed. It will be apparent to one of ordinary skill in the art that many modifications and variations are possible in view of the above teachings.

What is claimed:

1. A modular product display unit comprising:
a tray comprising:
a magnetic top surface; and
an apron at least partially surrounding the magnetic top surface and extending above the magnetic top surface;
display inserts disposed on and magnetically coupled to the magnetic top surface, the display inserts forming product-display compartments on the magnetic top surface,
wherein positions of the display inserts on the magnetic top surface are constrained only by the apron or other display inserts, and
wherein upper surfaces of the display inserts are coplanar with an upper surface of the apron.

2. The modular product display unit of claim 1, wherein the display inserts are reconfigurable on the magnetic top surface.

3. The modular product display unit of claim 1, wherein the display inserts are coupled to the magnetic top surface without mechanical fasteners.

4. The modular product display unit of claim 1, wherein the display inserts are linear and form rectangular compartments.

5. The modular product display unit of claim 1, wherein the display inserts comprise dividers and product stands.

6. The modular product display unit of claim 1, comprising product backers magnetically coupled to the magnetic top surface and each disposed within one of the compartments,
wherein the product backers comprise an upright support member extending away from the magnetic top surface for supporting product disposed within the compartments.

7. The modular product display unit of claim 6, further comprising products disposed within the compartments,
wherein the upright support members of the product backers extend above top surfaces of the apron, and
wherein the upright support members of the product backers do not extend above top surfaces of the products.

8. The modular product display unit of claim 1, wherein top surfaces of the display inserts do not extend above top surfaces of the apron.

9. The modular product display unit of claim 1, wherein at least one of a length or width of at least one of the compartments is at least 10 times its depth.

10. A retail display fixture comprising the product display unit of claim 1.

11. The modular product display unit of claim 1, wherein at least one end of at least one of the display inserts abuts the apron.

12. A modular product display drawer, comprising:
a magnetic surface;
display inserts magnetically coupled to the magnetic surface, the display inserts being reconfigurable on the magnetic surface to form product-display compartments;
a drawer support having a drawer slide configured to allow the magnetic surface to slide between a retracted position and an extended position; and
a product backer magnetically coupled to the magnetic surface within one of the compartments,
wherein the drawer support supports the magnetic surface in a cantilevered arrangement in both the retracted position and the extended position, and
wherein the product backer is not attached to the display inserts and extends above the display inserts.

13. The modular product display drawer of claim 12, wherein the product backer comprises an upright support member extending away from the magnetic surface for supporting product disposed within the compartment.

14. The modular product display drawer of claim 12, further comprising an apron surrounding and extending above the magnetic surface,
wherein the display inserts comprise linear dividers,
wherein the linear dividers and the apron form the compartments, and
wherein top surfaces of the display inserts do not extend above the apron.

15. The modular product display drawer of claim 12, wherein the product backer is configured to support a displayed product disposed within the product-display compartment in such a manner that the displayed product extends above and out from the product-display compartment.

16. A retail display fixture comprising:
a mounting surface;

display trays mounted to the mounting surface in a cantilevered arrangement, each of the display trays comprising:

a magnetic horizontal surface;

an apron at least partially surrounding the magnetic horizontal surface; and display inserts disposed on and magnetically coupled to the magnetic horizontal surface, the display inserts forming product-display compartments on the magnetic horizontal surface; and displayed products disposed within the product-display compartments, the displayed products extending above the display inserts and apron, wherein the display trays are movable toward and away from the mounting surface between a first position and a second position, and wherein each respective one of the display trays is vertically spaced apart from an adjacent display tray by a distance that is greater than a height of the respective display tray.

17. The retail display fixture of claim 16, wherein the display trays are mounted to the mounting surface in a column configuration.

18. The retail display fixture of claim 16, wherein each respective one of the display trays is vertically spaced apart from an adjacent display tray by between 1 and 5 times the height of the respective display tray.

19. The retail display fixture of claim 16, wherein each display tray further comprises:

drawer slides coupling the respective display tray to the mounting surface in the cantilevered arrangement, wherein the display inserts comprise:

dividers forming the compartments, wherein the dividers do not extend above the apron;

a product stand for supporting an unpackaged product for display; and a product backer for supporting packaged product within a compartment, wherein the display inserts are coupled to the magnetic horizontal surface without mechanical fasteners, and are reconfigurable on the magnetic horizontal surface.

20. A modular product display unit, comprising:

a tray having a top surface;

an apron surrounding and extending above the top surface;

display inserts movably disposed on the top surface, the display inserts forming product-display compartments on the top surface, wherein the display inserts protrude away from the top surface to form walls of the product-display compartments; and a retention mechanism that couples the display inserts to the top surface and holds the display inserts in position relative to the top surface, wherein the retention mechanism can be overcome by lifting the display inserts away from the top surface, wherein the retention mechanism can be engaged by placing the display inserts on the top surface, wherein the display inserts do not extend above the apron, and wherein the walls of the product-display compartments form a low profile that allows product disposed within the product-display compartments to extend above the compartments for display.

21. The modular product display unit of claim 20, wherein the retention mechanism includes magnetic attraction of the display inserts toward the top surface.

22. The modular product display unit of claim 20, wherein the retention mechanism comprises:

a first magnetic element at or below the top surface; and second magnetic elements forming at least a portion of each of the display inserts, wherein at least one of the first magnetic element and the second magnetic elements is a magnet.

23. The modular product display unit of claim 20, wherein the retention mechanism comprises:

a first magnetic element at or below the top surface; and second magnetic elements forming at least a portion of each of the display inserts, wherein the first magnetic element is a ferromagnetic panel, and the second magnetic elements are permanent magnets.

24. The modular product display unit of claim 20, wherein the retention mechanism does not include mechanical fasteners.

25. The modular product display unit of claim 20, wherein the retention mechanism can couple the display inserts to the top surface and hold the display inserts in position relative to the top surface at any position on the top surface.

26. The modular product display unit of claim 20, wherein the display inserts are not attached to each other.

27. The modular product display unit of claim 20, wherein at least some of the display inserts are in contact with the apron.

28. The modular product display unit of claim 20, further comprising:

a product stand disposed within one of the product-display compartments, wherein the product stand is spaced apart from the display inserts that define the one product-display compartment, and wherein the product stand extends above the apron.

* * * * *